United States Patent [19]

Wenstob et al.

[11] Patent Number: 4,919,067

[45] Date of Patent: Apr. 24, 1990

[54] SELF-RIGHTING MONOHULL VESSEL

[76] Inventors: Wayne B. Wenstob; Kevin J. Wenstob, both of 836 Cormorant Street, Victoria, B.C., Canada, V8W 1R1

[21] Appl. No.: 154,978

[22] Filed: Feb. 9, 1988

[30] Foreign Application Priority Data

Feb. 10, 1987 [CA] Canada ..... 529334

[51] Int. Cl.[5] ..... B64B 7/08

[52] U.S. Cl. ..... 114/345; 114/121; 114/125; 114/38

[58] Field of Search ..... 114/38, 61, 345, 121, 114/123, 125, 124, 68, 69; 441/40

[56] References Cited

U.S. PATENT DOCUMENTS

| | | | |
|---|---|---|---|
| 986,529 | 3/1911 | Wiking | 114/38 |
| 1,015,755 | 1/1912 | Cook et al. | 114/38 |
| 3,602,182 | 8/1971 | Cady | 114/38 |
| 4,227,474 | 10/1980 | Ulrich | 114/61 |
| 4,441,445 | 4/1984 | De Weck | 114/61 |

FOREIGN PATENT DOCUMENTS

| | | | |
|---|---|---|---|
| 44045 | 3/1980 | Japan | 114/123 |
| 259593 | 12/1985 | Japan | 114/125 |
| 47807 | 7/1978 | U.S.S.R. | 114/123 |

*Primary Examiner*—Sherman D. Basinger
*Assistant Examiner*—Thomas J. Brahan
*Attorney, Agent, or Firm*—Christopher Duffy

[57] ABSTRACT

A planing type self-righting boat having rigid pontoons forming its perimeter structure independent of interior inflation and which, during the vessel's normal operation, protect conventional or modified interior inflatable pontoons which elements together are used in whole or in part as essential mechanical components in the automatic self-righting of the vessel upon capsizing. The self-righting of the vessel after capsizing is effected by the creation of a negative buoyancy and subsequent sinking of that portion of the vessel whereby this submerging action combined with the weight and configuration of the vessel cause it to rotate underwater to a position beyond perpendicular to its capsized position while the vessel is supported by the buoyancy retained in the remainder of its pontoon structure. Upon submerging to its underwater position, the buoyancy is then returned to the underwater pontoons assembly causing a lifting action and effecting a continuation of the underwater rotation of the vessel to the normal upright operating position at the water surface.

13 Claims, 3 Drawing Sheets

SELF-RIGHTING MONOHULL VESSEL

This invention relates to monohull vessels of a typically, but not necessarily, planing type configuration and, more particularly, those having longitudinal flotation chambers connected at the bow and, oppositely spaced at the vessel's starboard and port sides, parallel to the boat's longitudinal axis. The construction material for those flotation chambers is of flexible inflated material and the vessels are commonly known as "inflatables" or "rigid hull inflatables". The advantages of such craft, including their stability and safety are well-known, however, their increasing use in open waters in search and rescue work make an effective, dependable and permanent self-righting capability necessary.

To self-right an overturned planing vessel various schemes have been proposed incorporating singly, or together, the use of topside buoyancy, in the form of an enlarged water tight cabin, or the use of overhead floatation consisting of various forms of fixed or overhead inflatable buoyancy on or above deck. Such methods can inhibit the function of the planing type boat during its normal operation and in the event of capsize, make self-righting recovery difficult, if not physically damaging for the occupants.

One method of self-righting known in a planing-type vessel consists of an inflatable unit mounted on the stern of the boat on an overhead roll bar. Upon the vessel capsizing, a manual or automatic release occurs, forcing compressed air into the inflatable unit, causing the stern of the vessel to rise out of the water and, with the help of gravity, the intent is that the vessel should roll back into an upright position.

At present, this is a common self-righting device incorporated into many planing vessels. However, the disadvantages are apparent. Capsize recovery is usually necessary only in turbulent seas and windy conditions. This prior art method exposes increasingly greater surface area of the vessel and inflatable unit to natural forces, threatening floating survivors as the vessel tumbles uncontrollably into an upright position. Further, when the vessel is self-righted, it is encumbered with the self-righting device inflated over the stern. The device must be removed and discarded before the vessel can resume normal operation, and the self-righting capability of the vessel is lost,though it may be still necessary.

The other references to self-righting systems known, are related to catamaran type craft. These systems are innapplicable to the function and configuration of a planing type vessel and require either extensive extraneous elements or inherent features only in the configuration of multihulls.

In the Ullrich invention (Oct. 14, 1980, U.S. Pat. No. 4,227,474), the prior art equips a catamaran with a self-righting device in which the forward hulls ofthe capsized vessel are simultaneously flooded, causing it to sink on its transverse axis, while being supported by a rear water tight cabin structure. When the vessel has submerged to a designated position, it is specified that compressed air be introduced, forcing the water from the submerged forward hulls in order to return the bow, and in turn, the catamaran, into a near upright position.

The feasibility of this prior art is questionable. Firstly, because the self-righting is dependant totally on the vessel rolling transversely, it defies its natural tendency to roll on its longitudinal axis. With any misplacement of stores or rigging, or if rough seas and wind are present, the hulls would sink unequally causing the vessel to list in a longitudinal motion. Once the vessel tended to this position, this effect would increase, resulting from the natural realignment of the centre of gravity and buoyancy. As the flooding of the hulls continues, the vessel's air-tight cabin becomes exposed to the forces of the wind, again increasing the instability of the proposed transverse roll. Secondly, when the compressed air is injected into the hulls, any uneveness of the transverse position would cause the unequal evacuation of water, tending to promote the vessel's natural longitudinal movement, with the result that the vessel rises at best in a diagonal fashion, and uprights itself with mast parallel to the water surface. Further to this, the ability of a vessel to carry the volume of compressed air required to perform the act envisioned by the prior art becomes impractical, and the unstable and uncontrollable listing action of the vessel on its longitudinal axis makes the prior art transverse self-righting device infeasible.

No other method of self-righting a planing hull vessel is known to the inventors.

In the prior art planing type boats known as "inflatables" or "rigid-hull inflatables", the structure, shape and safety of the vessel is dependent completely on the ability of the exposed pontoon portion being capable of retaining pressure. To overriding fault of the inflatable boat is its constant maintenance and danger of rupture of the flexible material of the pontoons which are subject to constant wear caused by its inability to withstand contact with abrasive or puncturing objects. To overcome the danger of rupture the inflatable pontoon boats have been equipped with extensive and elaborate safety 2-way valves; baffles to stop transfer of air from adjacent areas. devices solely to protect the vessel upon the aforementioned failure. No method is known to the inventors that has hereto been incorporated or devised to protect the material causing the aforementioned failure neopreene. In general, the existing protective systems employed with inflatable pontoon boats consists of chamberizing the pontoons into sections, isolated by baffles and controlled by valves. When failure of the material membrane occurs it is intended that only a portion of the vessel deflates, resulting in the vessel losing that designated portion of its stability and safety.

It is believed that all the prior art self-righting methods of planing hull vessels are dependent on concepts absent from the present invention which limit their range of application in each case to few of the potential improvements in performance and safety possible in the present inention.

We have found that the disadvantages apparent in prior art self-righting devices may be overcome in a monohull planing type boat by equipping the vessel with flotation chambers constructed of rigid material containing inflatable bags, and, by controlling air transference between the chambers during capsize, effect an underwater longitudinal roll on the vessel's axis, whereby the vessel regains an upright position with no danger to floating survivors with the system becoming a permanent repeating capability of the vessel.

BEST MODE FOR CARRYING OUT THE INVENTION

Figure 1:
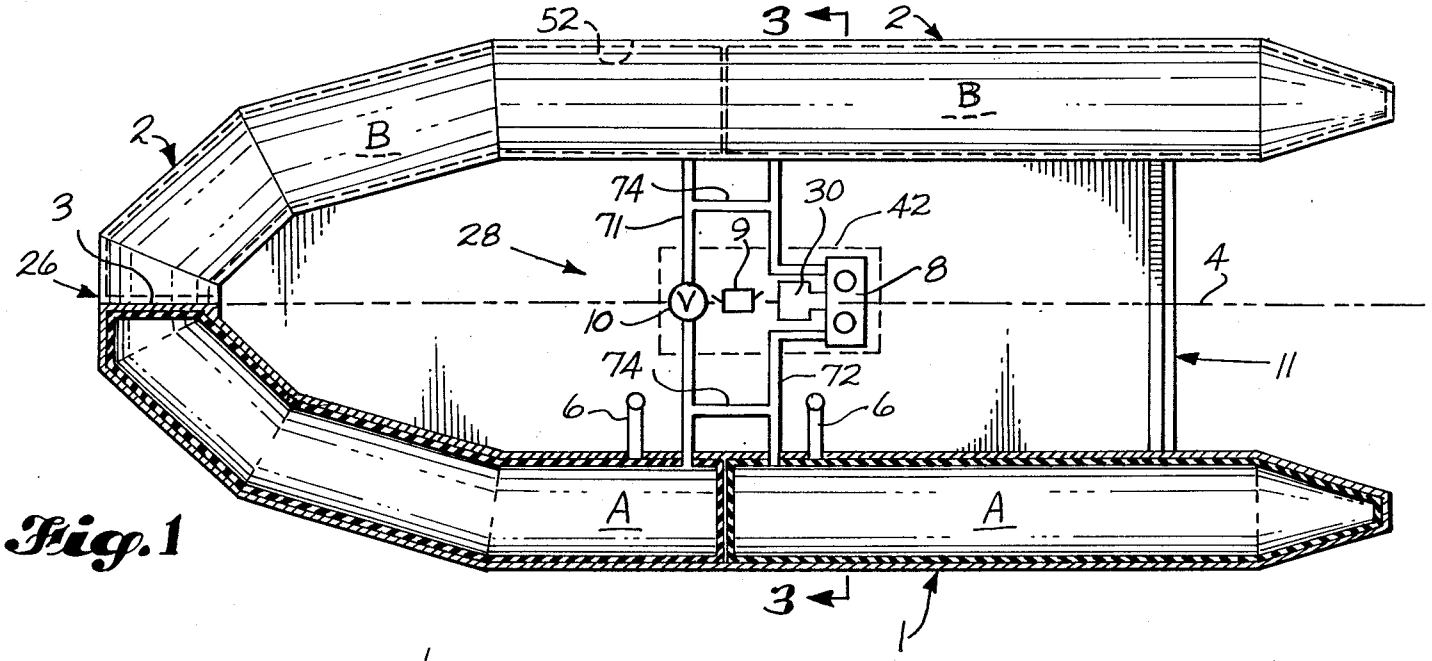
FIG. 1 shows a plan of a typical planing type vessel constructed in accordance to the preferred embodiment of the invention.

Referring to the drawings, it will be seen that the vessel has a water engaging hull 11 whose center of gravity lies on an axis 4 extending fore to aft thereof. The hull 11 is constructed from heavier than water material which contains little or no flotation, but it is flanked by a pair of elongated water engaging pontoons 1 and 2, the flotation chambers 51 and 52 of which are sized so that the buoyancy of either pontoon will support the total weight of the vessel and its contents. The pontoons 1 and 2 and chambers 51 and 52 are symmetrically arrayed about the aforesaid fore to aft axis 4 of the vessel, and extend on substantially parallel axes thereto in a generally horizontal plane when the vessel is disposed in the normal upright condition thereof on a body of ambient water 24, as in FIGS. 1–3. At one end 26 of the hull, however, the pontoons are interconnected with one another to form a bow for the vessel, and the bow connection has a bulkhead 3 therein which separates the chambers 51 and 52 from one another for reasons which will become apparent. In addition, the pontoons 1 and 2 are constructed so as to be capable of withstanding two atmospheres of pressure when the chamber 52 of the pontoon 2 on the starboard side of the vessel is pressurized, as shall be explained, or in the alternative, to retain their shape and form when the chambers 51 and 52 are unpressurized. In practice, the pontoons are often fabricated from a rigid metal or plastic composite material which has this combined capability.

The chambers 51 and 52 have corresponding pairs of resiliently flexible gas inflatable bags A and B tandemly arranged therein, and the bags are interconnected in a closed circuit with means 28 that are operable to transfer gas retained in the bags A of the chamber 51 in the pontoon 1 on the port side of the vessel, to the bags B contained in the chamber 2 of the pontoon 2 on the starboard side of the vessel, and vice versa. The bags B in the starboard chamber 52 are enclosed at all times, in that the chamber 52 is closed to the body of ambient water 24 at all times, regardless of the angular orientation of the vessel in the water. However, the bags A in the port chamber 51 are subject to sharing the chamber with the water, in that when the vessel assumes a capsized condition in the body of water, as in FIG. 4, the chamber 51 is open to the water through a pair of inlets 6 that penetrate the pontoon 1 at the upper side thereof when it is disposed in the normal upright condition thereof, as in FIGS. 1–3. The gas transfer means 28 include a pair of sealed gas lines 71 and 72 which extend between the pairs of bags A and B in a sealed water impervious enclosure 42 at the center of the hull 11. One line 71 is connected with the relatively more forward bags of the vessel, and the other 72 is connected with the relatively more rearward bags of the same, but the respective lines 71 and 72 are also interconnected with one another by a pair of spaced cross connections 74 so that each line actually communicates with both pairs of bags at the same time. The gas transfer means 28 also include a gas compressor 8 and an electric motor 30 or other means for powering the same, as well as a pressure control valve 10 for equalizing the pressure between the pairs of bags, and cooperating with the compressor 8 to effect transfer of the gas in the port bags A to the starboard bags B, and vice versa, when needed. The motor 30, compressor 8, and valve 10 are all housed in the enclosure 42, between the cross connections 74, and the compressor 8 is interposed in the line 72, and the valve 10 in the line 71, so that when the valve 10 is closed, the compressor 8 can be used to transfer gas from the port bags A to the starboard bags B, in the line 72, whereas when the valve 10 is open and the compressor 8 is deactivated, the line 71 will return the transferred gas to the port bags A from the starboard bags B.

When the vessel is in the normal upright condition thereof, the pairs of bags A and b are filled with gas and pressurized to fill their respective chambers. Moreover, the valve 10 is open and operative to equalize the pressure between the pairs of bags, and the gas compressor 8 is deactivated. However, the valve 10 and compressor 8 are accompanied by a control unit 9 which is sensitive to the angular orientation of the vessel about the axis 4 thereof, and responsive to certain angular orientations of the vessel, including the capsized condition thereof, to activate and deactivate the motor 30 of the compressor, and close and open the valve 10, in accordance with a predetermined scheme of operation designed to upright the vessel in a manner to be explained. Typically, the control unit 9 includes, either singly or in combination, a solenoid, a mercury switch, a computer, or some other similar means (not shown) which are responsive to the angular orientation of the vessel to generate a control signal at various stages of the operation, as shall be explained.

Initially, when the vessel capsizes in the water (FIG. 4), the control unit 9 responds to this condition by closing the valve 10 and activating the compressor 8 to cause the gas transfer means 28 to withdraw a portion of gas from the bags A of the port chamber 51 and add that portion of gas to the bags B of the starboard chamber 52. The bags B of the starboard chamber 52 are larger in dimension than the chamber 52 itself, so that as they overinflate, the increased gas supply builds up pressure within them and converts them into a reservoir of highly pressurized gas, typically at two atmospheres of pressure. Meanwhile, the bags A of the port chamber 51 are depressurized to the extent that the water 24 enters the chamber 51 through the inlets 6. This reduces the buoyancy of the portside of the vessel and shifts the center of gravity away from the starboard chamber 52. This, in turn, produces a force operating to rotate the vessel about the axis of the starboard chamber in the direction relatively downward from the horizontal plane occupied by the axes of the two chambers. See FIG. 5. Ultimately, the nonbuoyancy of the portside pontoon 1, the weight of the vessel as a whole, and the location of the other components of the vessel, add up to a force which rotates the vessel about the axis of the chamber 52 through an angle greater than 90° from the aforesaid horizontal plane. See FIG. 6. At this point, the control unit 9 is operable next to deactivate the gas compressor 8 and reopen the valve 10, so that the highly pressurized gas of the starboard chamber can return to the bags A of the port chamber. Given a condition in which the line 71 and the inlets 6 provide balanced flow of volume with minimum resistance at a pressure of two atmospheres, the newly reinflating bags A will readily displace the water occupying the port chamber 51, and this, in turn, will induce the vessel to continue rotating about the axis of the starboard chamber 52 in the direction relatively upward of the plane, so as to return the vessel to the normal upright condition thereof. At this point, the valve 10 again operates to equalize the buoyancy of the respective chambers 51 and 52, by equalizing the pressure in the respective pairs of bags A and B, and the vessel resumes its normal operating capability. See FIG. 7.

Figure 7:
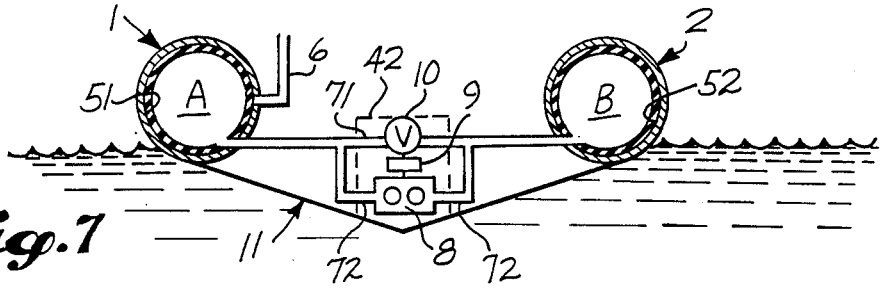
FIG. 7 is a section through the vessel shown in FIG. 1 at the section line 12 of FIGS. 1 and 2 of the vessel selfrighted.
Figure 8:
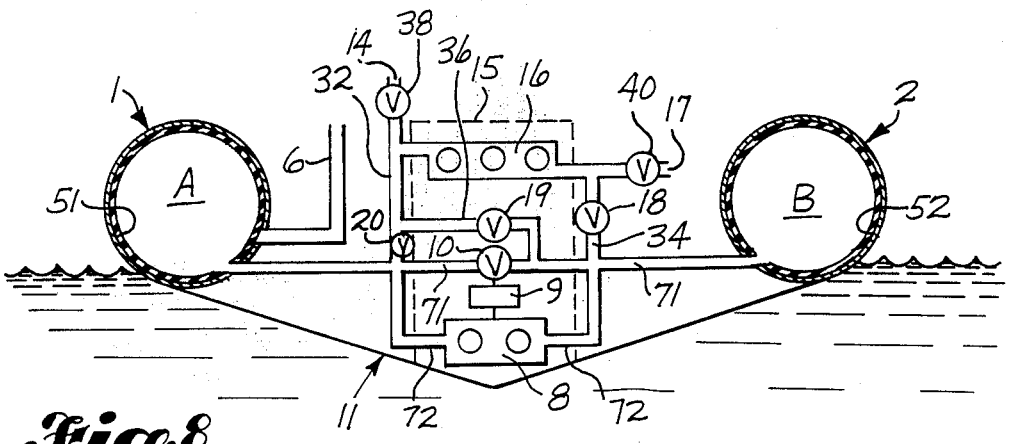
FIG. 8 is a section located at the position 12 on FIGS. 1 and 2 through a vessel showing another embodiment of the invention which would contain an additional power source to that of the preferred embodiment.

In the alternative embodiment of FIG. 8, the vessel is adapted to undergo the maximum self-righting speed by incorporating in the self-righting system, the same power source which is used to power the vessel itself in the normal operation thereof. The sealed gas lines 71 and 72, the motor-driven compressor 8, and the valve 10 used in conjunction with the embodiment of FIGS. 1–7, can be seen in FIG. 8 as well. Accompanying them in the sealed enclosure 15, however, is a combustion engine 16 having an air intake 14 and an exhaust 17 which penetrate the wall of the enclosure 15 to the ambient air about the vessel. Outside the enclosure, moreover, the intake line 14 is interconnected at 32 with the port side of the line 72 of the compressor 8, whereas the exhaust line 17 is interconnected at 34 with the starboard side of the line 72 of the compressor. The intake connection 32 is also interconnected with the line 71 of the valve 10, on the starboard side of the valve, by a further connection at 36. The intake 14 and exhaust 17 are equipped, furthermore, with valves 38 and 40 of their own, and each of the connections 32, 34 and 36 is also equipped with a valve seen at 20, 18 and 19, respectively. The control unit 9 of the earlier embodiment is connected with each of the valves 38, 40, 20, 18, 19 and 10, and the sealed enclosure 15 is positioned so that the majority of the combined weight of the various components therewithin is located below the horizontal plane having the axes of the chambers 51 and 52 of the pontoons 1 and 2 therein.

In the normal operating condition of the vessel, the air intake valve 38 is open, the line valves 18 and 20 are closed, and the high temperature exhaust valve 40 is open. The line valve 19 is also closed, and as in the embodiment of FIGS. 1–7, the valve 10 is open and operating to equalize the buoyancy of the respective pontoons 1 and 2. If the combustion engine 16 is not operational when the vessel capsizes, the self-righting system is activated by the control unit 9 and operates as described in the embodiment of FIGS. 1–7. On the other hand, if the combustion engine 16 is operating when the vessel capsizes, the control unit closes the valves 38, 40 and 10, and opens the valves 20 and 18, to produce a condition in which the engine 16 replaces the function of the compressor 8 in the embodiment of FIGS. 1–7. As the engine continues to operate, the air supply for the same is drawn from the bags A in the port pontoon 1, once again causing that side of the vessel to lose its buoyancy; while the exhaust from the engine is forced into the bags B of the starboard pontoon 2, so that the vessel undergoes downward rotation about the axis of the same, as in the earlier embodiment. When the air in the bags A of the port pontoon 1 is insufficient for the operation of the engine, the control unit 9 opens the valve 19, to allow sufficient mixed air and exhaust gas to be returned to the air intake of the engine to maintain its operation. Thereafter, when the vessel has rotated to a position comparable to that shown in FIG. 6 of the earlier embodiment, the control unit 9 closes valve 20 and opens valve 10, causing the compressed exhaust gases and air stored in the pontoon 2 to be reintroduced to the bags A in the pontoon 1, in the same manner as was described for the embodiment of FIGS. 1–7. Finally, when the vessel has resumed its normal operating condition, the control unit 9 opens valve 38 and 40, and closes valve 18, to permit the engine to operate in its normal condition and to perform the self-righting task again, if needed.

The automatic control system 9 in the embodiment and alternate embodiment would be designed according to known methods of analysis and could employ various currents or voltage regulating devices, selinoids, servomechanisms, electrical sensors, magnetic relays, or electrical switching circuits such as digital logic circuits.

The foregoing is considered as illustrative only of the principals of the invention and it is obvious that further modifications to the invention as presented could be effected by such things as deletion of the inflatable bags 5 in pontoon assembly B but it is not desired to limit the invention to the exact construction and operation shown and described and accordingly, while only a few of the embodiments possible of the present invention have been shown and described, it will be obvious to those persons of ordinary skill in the art that many changes and modifications may be made thereunto without departing from the spirit and scope of the invention.

The devise and subject matter of the invention is usable more particularly for planing type vessels which have a relatively high centre of gravity and wide beam in relation to their length but is also applicable to displacement vessels, hydrofoils, high speed cruising or coastal boats or racing craft.

The embodiments ofthe invention in which an exclusive property or privilege are claimed are defined as follows:

1. In an operatively water borne vessel whose center of gravity lies on an axis extending fore to aft thereof, water-engaging hull-forming means defining a pair of first and second flotation chambers therewithin which are symmetrically arrayed about the aforesaid fore to aft axis of the vessel and extend on substantially parallel axes thereto in a generally horizontal plane when the vessel is disposed in the normal upright condition thereof on a body of ambient water, said first and second flotation chambers having first and second means enclosed therewithin, respectively, for retaining gas under pressure, means interconnected in a closed circuit with the respective first and second gas retention means. and operable to transfer gas retained in the first gas retention means to the second gas retention means, and vice versa, the first gas retention means taking the form of a resiliently flexible gas-inflatable bag which is enclosed with the first flotation chamber to occupy alternately greater or lesser volume of the chamber, depending upon whether gas is added to or withdrawn from the bag, respectively, means operable to control the operation of the gas transfer means in accordance with the angular orientation of the vessel about the fore to aft axis thereof, said control means being responsive to the vessel capsizing in the body of ambient water to cause the gas transfer means to withdraw a portion of gas from the bag and add the portion to the second gas retention means, liquid transfer means operable to open the first flotation chamber to the body of ambient water when the vessel has assumed the capsized condition thereof in the water, so that ambient water occupies that portion of the first flotation chamber evacuated by the bag when the portion of gas is withdrawn therefrom, means closing the second flotation chamber to the body of ambient water when the portion of gas is added to the second gas retention means, so that the addition of water to the first flotation chamber shifts the center of gravity of the vessel further away from the axis of the second flotation chamber and induces the vessel to rotate about the same in the direction relatively downward from the aforesaid horizontal plane, the control means being operable to cause the gas transfer means to return the aforesaid portion of gas to the bag in the first flotation chamber when the vessel has rotated downward about the axis of the second flotation chamber through an angle greater than 90° from the aforesaid horizontal plane, so that the water occupying the first flotation chamber is displaced from the same by the bag to induce the vessel to continue rotating about the axis of the second flotation chamber in the direction relatively upward toward the aforesaid horizontal plane, and to thereby return to the normal upright condition thereof, and means operable to equalize the buoyancy of the respective first and second flotation chambers when the vessel has resumed the normal upright condition thereof.

2. The operatively water-borne vessel according to claim 1 wherein the gas transfer means include a gas pump and means defining first and second fluid flow passages interconnecting the gas pump with the bag and the second gas retention means so that gas can be transferred therebetween by the pump.

3. The operatively water-borne vessel according to claim 2 wherein the bag and second gas retention means are directly interconnected by a third fluid flow passage having a control valve therein, and the control means are operable to activate and deactivate the gas pump and close and open the control valve, respectively.

4. The operatively water-borne vessel according to claim 3 wherein the second gas retention means take the form of a second resiliently flexible gas inflatable bag which is enclosed within the second flotation chamber, and the gas pump and bags are interconnected by the first, second, and third fluid flow passages in a closed loop.

5. The operatively water-borne vessel according to claim 2 wherein the gas pump takes the form of an air compressor.

6. The operatively water-borne vessel according to claim 2 wherein the gas pump takes the form of a combustion engine, the air supply of which is connected with the bag and the exhaust of which is connected with the second gas retention means.

7. The operatively water-borne vessel according to claim 1 wherein the gas transfer means include a pair of gas pumps and means defining pairs of fluid flow passages interconnecting the respective gas pumps with the bag and the second gas retention means so that gas can be transferred therebetween by either gas pump.

8. The operatively water-borne vessel according to claim 7 wherein the bag and second gas retention means are directly interconnected by a fifth fluid flow passage having a control valve therein, and the control means are operable to activate and deactivate either gas pump and close and open the control valve, respectively.

9. The operatively water-borne vessel according to claim 8 wherein one gas pump takes the form of an air compressor and the other gas pump takes the form of a combustion engine, the air supply of which is connected with the bag and the exhaust of which is connected with the second gas retention means.

10. The operatively water-borne vessel according to claim 1 wherein the flotation chambers are defined by a pair of spaced parallel water engaging pontoons.

11. The operatively water-borne vessel according to claim 10 wherein the pontoons have a bow-forming connection therebetween, which is bulkheaded to separate the respective chambers from one another.

12. The operatively water-borne vessel according to claim 10 wherein the pontoon defining the first flotation chamber has a normally upstanding water flow tube thereon which is operable to open the first flotation chamber to the body of ambient water when the vessel assumes the capsized condition thereof in the same.

13. The operatively water-borne vessel according to claim 1 wherein the flotation chambers are interconnected by a fluid flow passage and there is a valve in the passage which is operable to equalize the pressures of the respective chambers when the vessel has resumed the normal upright condition thereof.

* * * * *

UNITED STATES PATENT AND TRADEMARK OFFICE

CERTIFICATE OF CORRECTION

PATENT NO. : 4,919,067

DATED : April 24, 1990

INVENTOR(S) : Wayne B. Wenstob; Kevin J. Wenstob

It is certified that error appears in the above-identified patent and that said Letters Patent is hereby corrected as shown below:

Column 7, Claim 1, Line 11 of the Column, "with" should be "within".

Signed and Sealed this

Twenty-ninth Day of October, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,919,067

DATED : April 24, 1990

INVENTOR(S) : WAyne B. Wenstob; Kevin J. Wenstob

It is certified that error appears in the above-identified patent and that said Letters Patent is hereby corrected as shown below:

Column 3, delete lines 1 through 25 and substitute the following:

Brief Description of the Drawings

The invention will be better understood by reference to the accompanying drawings wherein we have illustrated a monohull vessel of the planing type which is equipped to undergo the foregoing roll for self-righting purposes when capsized.

Figure 2:
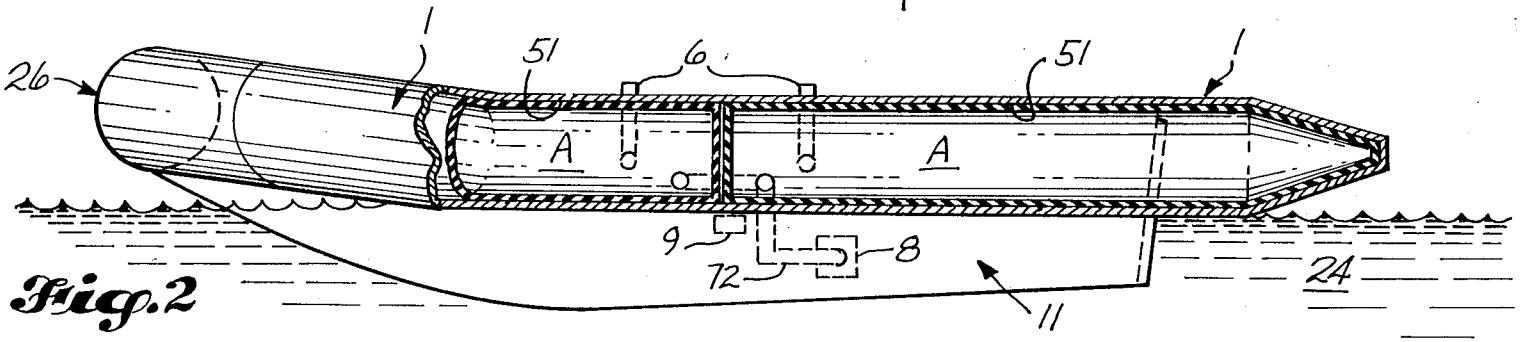
FIG. 2 is an elevation and partial section of the vessel shown in FIG. 1.
Figure 3:
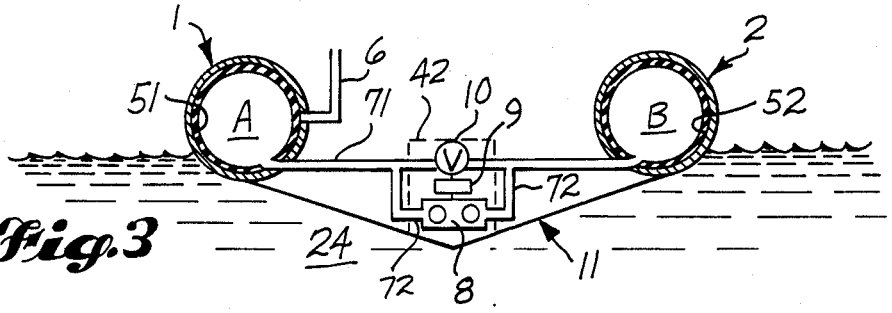
FIG. 3 is a section through the vessel shown in FIG. 1 at the section line 12 of FIGS. 1 and 2.
Figure 4:
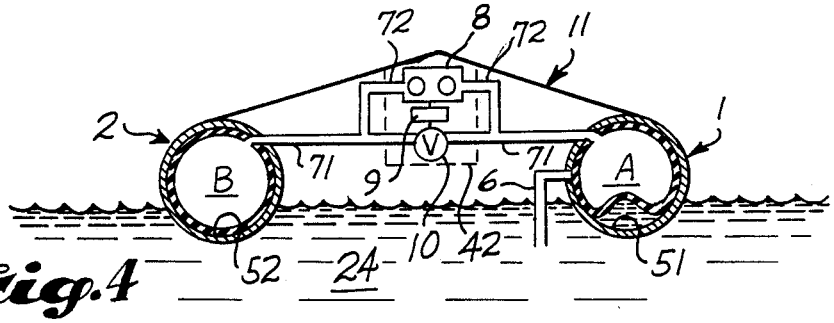
FIG. 4 is a section through the vessel shown in FIG. 1 at the sction line 12 of FIGS. 1 and 2, in a capsized position.
Figure 5:
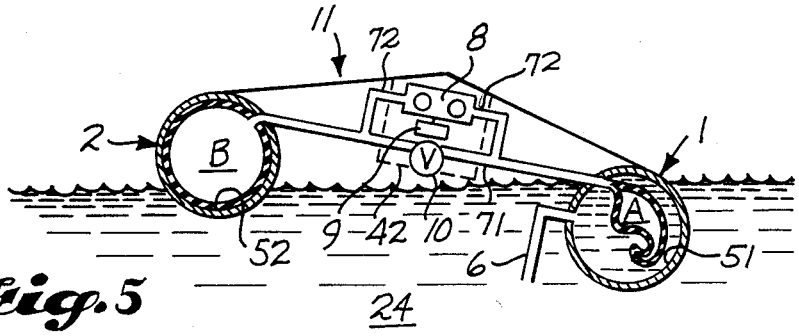
FIG. 5 is a section through the vessel shown in FIG. 1 at the section line 12 of FIGS. 1 and 2, of the capsized vessel submerging.

In the drawings:

Figure 1 is a plan view of the vessel in the upright condition thereof;

Figure 2 is a part cross-sectional, side elevational view of the vessel in such condition;

Figure 3 is a part cross-sectional view of the vessel along the line 3 - 3 of Figure 1 when the vessel is in the upright condition thereof;

Figure 4 is a similar part cross-sectional view of the vessel when the vessel is in the capsized condition thereof;

Figure 5 is a third such view of the vessel when it is in the initial stage of being uprighted again;

UNITED STATES PATENT AND TRADEMARK OFFICE

CERTIFICATE OF CORRECTION

PATENT NO. : 4,919,067

DATED : April 24, 1990

INVENTOR(S) : WAyne B. Wenstob; Kevin J. Wenstob

Figure 6:
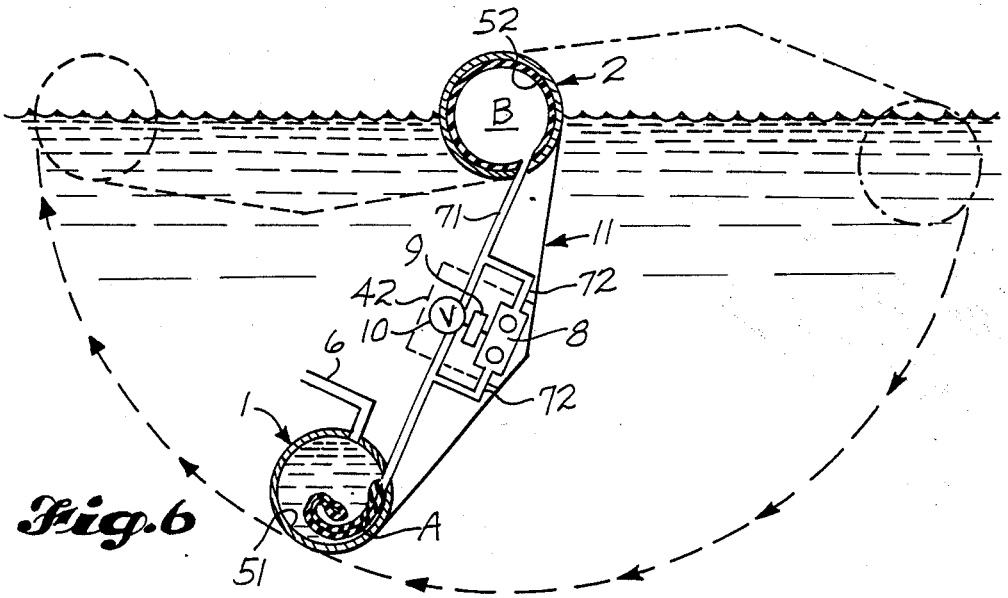
FIG. 6 is a section through the vessel shown in FIG. 1 at the section line 12 of FIG. 1 and 2 of the capsized vessel at the position of self-righting.

It is certified that error appears in the above-identified patent and that said Letters Patent is hereby corrected as shown below:

Figure 6 is a fourth such view of the vessel when it is in a later stage of being uprighted again;

Figure 7 is a fifth such view of the vessel when it has been fully uprighted again; and Figure 8 is a sixth such view of the vessel when it has been modified to incorporate in the self-righting mechanism the power source which is used in powering the vessel itself.

Column 7, claim 1, line 11, "with" should read --within--.

Signed and Sealed this

Twenty-first Day of January, 1992

*Attest:*

*Attesting Officer*

HARRY F. MANBECK, JR.

*Commissioner of Patents and Trademarks*